United States Patent [19]

Lunenschloss et al.

[11] Patent Number: 4,918,864

[45] Date of Patent: Apr. 24, 1990

[54] VARIABLE SPEED DOOR OPERATOR

[75] Inventors: John T. Lunenschloss; Henry M. Ebbott, both of Madison; Raymond A. Beckeman, McFarland; Glen M. Gregerson, Janesville, all of Wis.

[73] Assignee: Air-Lec Industries, Inc., Madison, Wis.

[21] Appl. No.: 246,979

[22] Filed: Sep. 20, 1988

[51] Int. Cl.[5] ..... E05F 15/02

[52] U.S. Cl. ..... 49/137; 49/138; 49/363

[58] Field of Search ..... 49/137, 138, 141, 360, 49/362, 363

[56] References Cited

U.S. PATENT DOCUMENTS

| | | |
|---|---|---|
| 3,244,415 | 4/1966 | Lunenschloss et al. . |
| 3,291,003 | 12/1966 | Lunenschloss et al. . |
| 3,921,335 | 11/1975 | Hewitt et al. . |
| 3,936,977 | 2/1976 | Runft et al. . |
| 3,938,282 | 2/1976 | Goyal . |
| 4,215,844 | 8/1980 | Bowen . |
| 4,290,368 | 9/1981 | Mazzini . |
| 4,318,333 | 3/1982 | Cemenska . |
| 4,369,696 | 1/1983 | Klatt et al. . |
| 4,471,805 | 9/1984 | Solie et al. . |

*Primary Examiner*—Kenneth J. Dorner
*Assistant Examiner*—Gerald A. Anderson
*Attorney, Agent, or Firm*—Lathrop & Clark

[57] ABSTRACT

A variable speed controller for selectively varying a moving speed of a door which is moved between first and second positions by an automatic door operator having a control system and a cylinder with a reciprocating piston therein which is positioned identically with respect to the cylinder when the door is in both the first and second positions, includes first and second passageways, and at least one door position responsive valve means operably connected to the control system, cylinder and passageways for directing fluid from the control system through the first passageway to the cylinder to initiate movement of the door toward the second position when the door is in proximity to its first position and the control system is discharging the fluid, and for directing fluid from the control system through the second passageway to the cylinder to initiate movement of the door toward the first position when the door is in proximity to its second position and the control system is discharging the fluid. The controller also includes a variable push valve in the second passageway which permits unrestricted fluid flow from the cylinder to be exhausted through the second passageway, and which permits selectively variable restriction of fluid flow from the control system to the cylinder through the second passageway so that movement of the door from the second position to the first position may be initiated at a selected speed.

12 Claims, 6 Drawing Sheets

VARIABLE SPEED DOOR OPERATOR

BACKGROUND OF THE INVENTION

1. Field of the Invention

The present invention relates to automatic door operators, and more specifically to improvements in the control of automatic door operators.

2. Description of the Related Art

Three different types of automatic door operators with single-action cylinders are disclosed in U.S. Pat. Nos. 3,244,415 and 3,291,003 to Lunenschloss, et al. These include the swing operator which returns to the same position whether the door is opened or closed, the over-center operator which is used to open and close a sliding door and which pivots sidewardly with the door, and the inertia operator which also is used with sliding doors and which interacts with a door only when the door is near its open or closed position. These three door operators as disclosed are controlled by either the pneumatic circuit control system or the electrically operated pneumatic control system. With both systems, the speed at which the door opens and closes may be adjusted to be faster or slower, however, the opening and closing speeds are not adjusted independently from one another. In some applications, it is desirable that a door close more slowly than it opens.

U.S. Pat. No. 3,936,977 to Runft, et al. and U.S. Pat. No. 3,921,335 to Hewitt, et al. disclose door operators with double-acting cylinders which can be used to cause the door to open and close at varying speeds.

SUMMARY OF THE INVENTION

The present invention is summarized in that a variable speed controller, for selectively varying a moving speed of a door which is moved between first and second positions by an automatic door operator having a control system and a cylinder with a reciprocating piston therein which is positioned identically with respect to the cylinder when the door is in both the first and second positions so that the cylinder must be exhausted when returning to either position, includes a first passageway, a second passageway, and at least one door position responsive valve means operably connected to the control valve, cylinder and passageways for directing fluid from the control valve through the first passageway to the cylinder to initiate movement of the door toward the second position when the door is in proximity to its first position and the control valve is discharging the fluid, and for directing fluid from the control valve through the second passageway to the cylinder to initiate movement of the door toward the first position when the door is in proximity to its second position and the control valve is discharging the fluid. Additionally, the variable speed controller furthermore includes a variable push valve in the second passageway which permits unrestricted fluid flow from the cylinder to be exhausted when fluid is exhausted from the cylinder through the second passageway, and which permits selectively variable restriction of fluid flow from the control valve to the cylinder through the second passageway so that movement of the door from the second position to the first position may be initiated at a selected speed.

A swing, over-center, inertia, or other similar door operator which incorporates the variable speed controller thus becomes a variable speed door operator which can move a door between a first (closed) and second (open) positions at different speeds. Thus the variable speed door operator of the invention is capable of closing a door at a slower rate than the speed at which it opens the door.

A primary object of the invention is to provide a variable speed door operator with a single-acting cylinder which closes a door at a slower rate than it opens the door, and alternatively opens a door at a slower rate than it closes the door.

Another object of the present invention is to provide a variable speed controller which can be utilized with a swing, over-center, inertia, or other similar operator to move a door between the open and closed positions at independent speeds.

An additional object of the present invention is to provide a variable speed controller and variable speed door operator which allow for the independent adjustment of the rate at which the door slows down as it approaches its respective closed or open positions.

A further object of the present invention is to provide a variable speed controller which may be added to an already existing door operator to allow the user to more precisely adjust the speed at which the door moves to the first or closed position, so that the speed is different than the speed at which the door moves toward its second or open position.

Yet another object of the present invention is to provide a variable speed controller which may be installed in an already existing door operator, and which allows a user to easily adjust the rate at which a door slows down as it reaches either of its open or closed positions.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
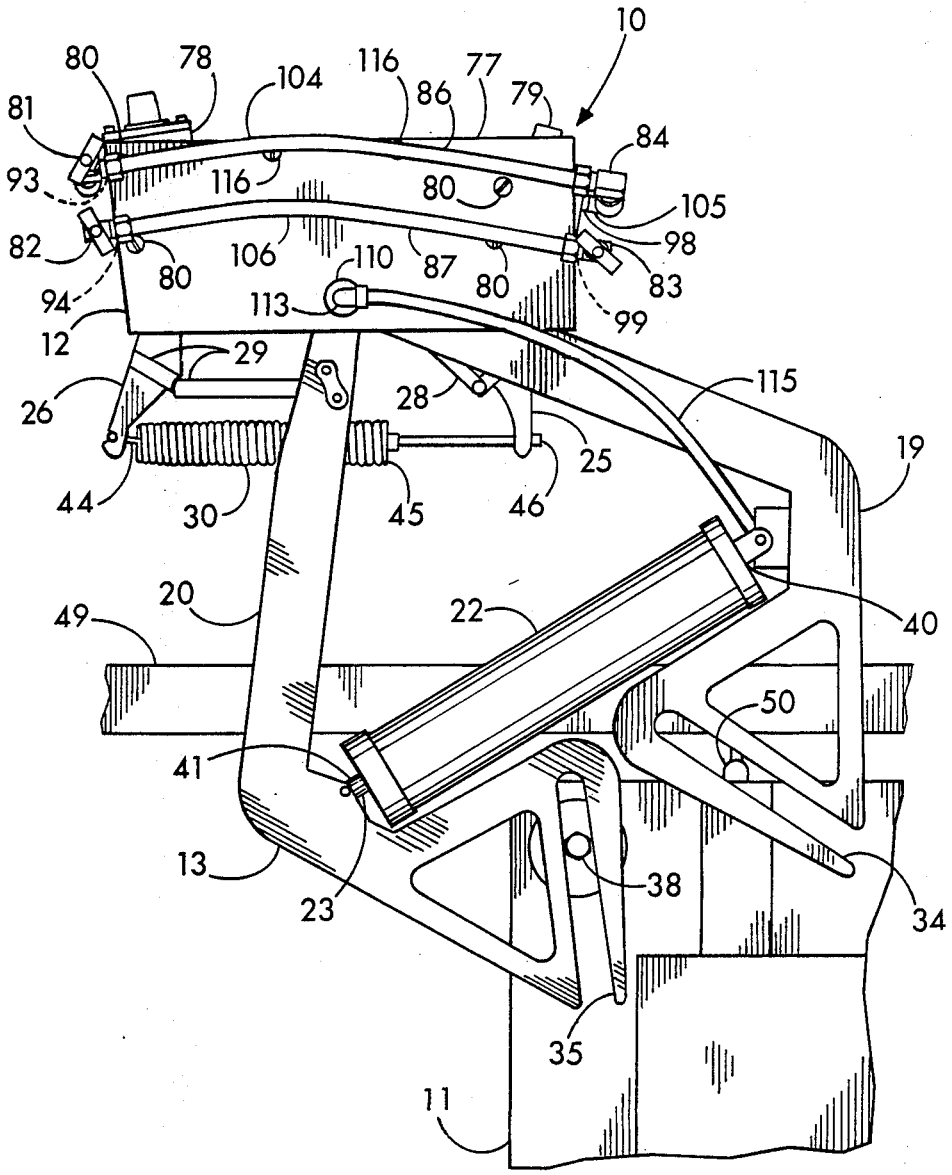
FIG. 1 is a front elevational view of a variable speed door accordance with the invention.

Referring more particularly to the drawings, wherein like numbers refer to like parts, FIG. 1 shows a variable speed door operator 10 which is used for opening and closing a door and which is adjustable so that the door 11 can be closed at a slower speed than it is opened. The variable speed door operator therefore is improved over the swing, over-center, and inertia operators disclosed in U.S. Pat. Nos. 3,244,415 and 3,291,003 to Lunenschloss, et al., the disclosures of which are hereby incorporated herein by reference. As shown in FIG. 1, the variable speed door operator 10 is comprised of a variable speed controller 12, and the earlier disclosed inertia operator 13 with some modifications. The inertia operator 13 includes substantially all of the pneumatic circuit control system 15 with pilot type control valve 16, which is disclosed in U.S. Pat. No. 3,244,415 to Lunenschloss, et al. Although the preferred embodiment disclosed herein substantially incorporates the inertia operator 13 with the pneumatic circuit control system 15, the variable speed controller 12 could also be modified for use with the swing and over-center operators, or with the electrically operated pneumatic control system disclosed in U.S. Pat. No. 3,291,003 to Lunenschloss, et al. The preferred variable speed door operator 10 disclosed herein, however, utilizes the inertia operator 13 for exemplification.

The inertia operator 13 shown in FIGS. 1–2 and 6–7 is adapted to open any sliding door 11. The inertia operator 13 is supported by a frame 18 which may be secured to a wall by bolts or other similar means. The inertia operator 13 includes a right main lever 19, a left main lever 20, a cylinder 22 with reciprocating piston 23, a right and a left arm 25 and 26, a right and a left link 28 and 29, and a spring 30. The right and left main levers 19 and 20 are each pivotally attached to the frame 18 by a pin 32, and each has a slot 34 or 35. The right main lever slot 34 is adapted to engage a right door post 37, and the left main lever slot 35, a left door post 38. The sliding door 11, from which the right and left door posts 37 and 38 project, is preferably supported in slidable relation on a track 49 by means of rollers (not shown) attached to hangers 50 or other suitable means.

The right end 40 of the cylinder 22 is pivotally connected to the right main lever 19 by a pin or other means. The left end 41 of the piston 23 is pivotally connected to the left main lever 20 by a pin or other means. The upper end of the left arm 26 is pivotally secured to the frame 18 by a pin, while its lower end is pivotally secured to the left end 44 of the spring 30 by a pin. The upper end of the right arm 25 is pivotally attached to the frame 18 by a pin, and its lower end is attached to the right end 45 of the spring 30 by a screw 46 or other means which will allow the tension in the spring 30 to be adjusted. The right link 28 is pivotally connected to both the right arm 25 and the right main lever 19 by pins or other similar means, and the left link 29 is pivotally connected to both the left arm 26 and the left main lever 20 also by pins or other means.

Figure 3:
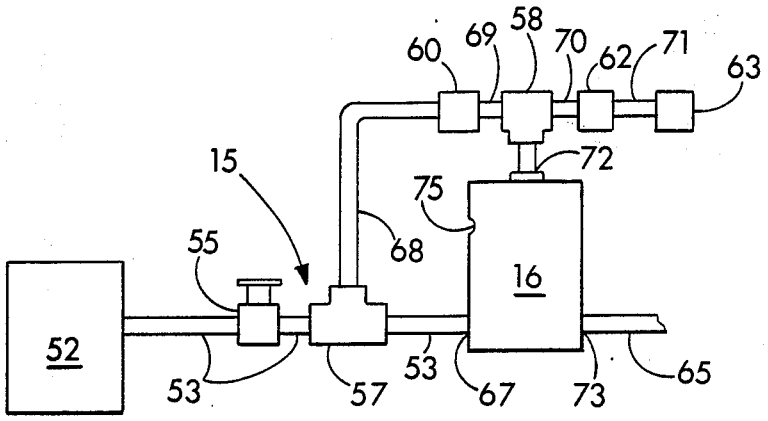
FIG. 3 is a schematic diagram of the preferred pneumatic circuit control system which is used in the variable door operator of FIG. 1.

The preferred pneumatic contol system 15 of the inertia operator 13 is shown schematically in FIG. 3. The pneumatic control system 15 includes a source 52 of pressurized fluid, a main fluid line 53, a normally open needle valve 55 or other similar means to control the flow of fluid in the line 53, T-connectors or joints 57 and 58, an energizing valve or valves 60, two bleed valves 62 and 63, the combination pressure-bleed piloted control valve 16, and an outlet line 65. The arms of the T-joint 57 are in the main fluid line 53 which is connected to the inlet 67 of the control valve 16. A branch line 68 connects the leg of the T-joint 57 with the energizing valve or valves 60. The energizing valve or valves 60 is connected by a line 69 to one arm of the second T-joint 58. The other arm of the second T-joint 58 is connected by a line 70 to the first bleed valve 62, which in turn is connected by a line 71 to the second bleed valve 63. The leg of the second T-joint 58 is connected to the pilot inlet 72 of the control valve 16 for operating the control valve 16. The outlet line 65 extends from the outlet 73 of the control valve 16. The outlet line 65, as disclosed in U.S. Pat. No. 3,244,415 to Lunenschloss, et al., was connected to a variable check valve which in turn was connected to the cylinder 22. That variable check valve is unnecessary when the variable speed controller 12 is added to the inertia operator 13 to form the variable speed door operator 10. The outlet line 65 is now instead directly connected to the variable speed controller 12, which in turn is connected to the cylinder 22.

Operation of the pneumatic control system 15 of FIG. 3 is begun by momentarily opening, either manually or by electrical means, the energizing valve 60. Opening the energizing valve 60 allows a rush of compressed air to enter the control valve 16 through the pilot inlet 72, thereby energizing the control valve 16 to allow compressed air to flow from the inlet 67 of the control valve 16 to the outlet 73. The energizing valve 60 may then be closed. The control valve 16 will continue to allow compressed air to pass between the inlet 67 and the outlet 73 until the control valve 16 is deenergized. The energizing valve 60 therefore is an energizing means connected to the control valve 16 for causing the control valve core (not shown) to be moved to a first position in which compressed air is allowed to flow from the inlet 67 to the outlet 73 until the control valve 16 is deenergized. Air which flows through the outlet line 65 is directed to the variable speed controller 12. The first and second bleed valves 62 and 63 are deenergizing means connected to the control valve 16 for causing the control valve core (not shown) to return to the second position when the two bleed valves 62 and 63 are opened. When both bleed valves 62 and 63 are opened simultaneously to the atmosphere, the pressurized air which moved the control valve core to the first position is vented so that the control valve core moves to the second position in which the flow of pressurized air from the inlet 67 to the outlet 73 is interrupted, and pressurized air is allowed to pass from the outlet 73 out an exhaust orifice 75 in the control valve 16. With the inertia operator 13, the control valve 16 is deenergized when the main lever arms 19 and 20 press against both bleed valves 62 and 63. When this occurs, the sliding door 11 will be located in some position intermediate the first and second positions, moving from one position to the other.

Figure 2:
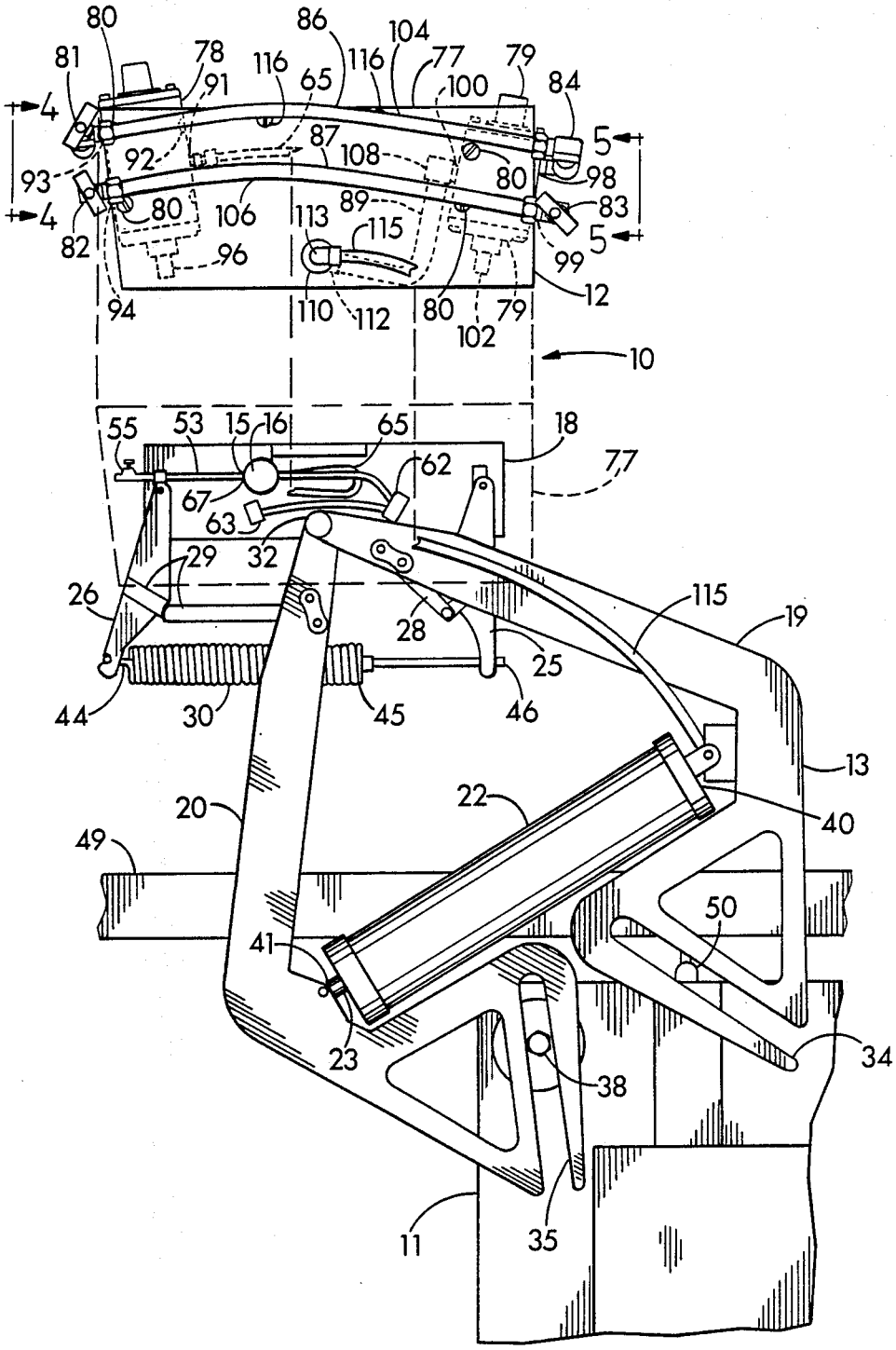
FIG. 2 is a front elevational view of the variable speed door operator of FIG. 1, with the variable speed controller projected above the inertia operator, and the door in its first position which corresponds to the closed position.
Figure 4:
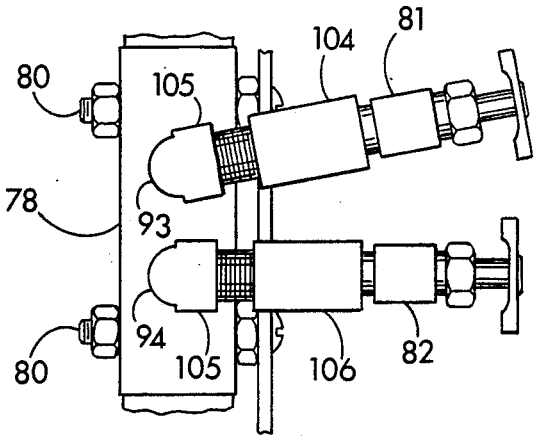
FIG. 4 is a side view taken along line 4—4 of FIG. 2.
Figure 5:
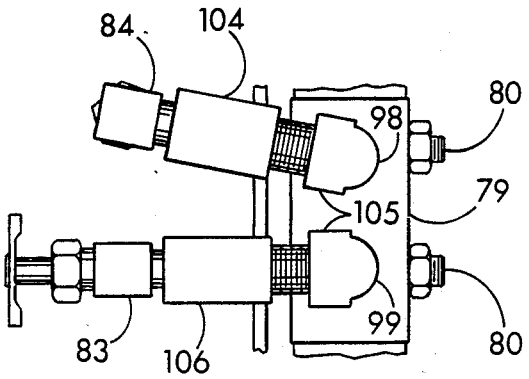
FIG. 5 is a side view taken along line 5—5 of FIG. 2.

As shown in FIGS. 2, 4 and 5, the variable speed controller 12 includes a plate 77, a four-way, two position first valve 78, a three-way, two position second valve 79, three variable check valves 81, 82 and 83, an elbow 84, an upper line 86, a lower line 87, and a cylinder port line 89. Each of the two valves 78 and 79 are attached to the plate 77 with two bolts 80. The first valve 78 includes a body which has a supply port 91, an exhaust port 92, a first port 93 and a second port 94; and a core (not shown) which moves between a normal position, and an actuated position. Connected to the bottom of the core (or constructed as part of the bottom of the core) is a first sensor actuator 96 which when pushed up by the left main lever 20 moves the core into the actuated position. Otherwise, the core is in its normal position. When the first valve (actually the core) is in its normal position, the valve 78 permits the passage of fluid between the supply port 91 and the first port 93, blocks the passage of fluid between the supply port 91 and the second port 94, and also blocks the passage of fluid from the first port 93 to the exhaust port 92. When the first valve 78 (actually the core) is said to be in its actuated position, the valve 78 permits the passage of fluid between the supply port 91 and the second port 94, permits the passage of fluid from the first port 93 to the exhaust port 92, and blocks the passage of fluid between the supply port 91 and the first port 93.

The second valve 79 includes a body having a first port 98, second port 99 and a cylinder port 100; and a core (not shown) within the body which is movable between a normal position and an actuated position. Connected to the lower end of the core (or formed as a part of the bottom of the core) is a second sensor actuator 102 which when pushed upwardly by the right main lever 19 moves the core into its actuated position. Otherwise, the core remains in its normal position. When the second valve 79 (actually the core) is in its normal position, the valve 79 permits the passage of fluid between the second port 99 and the cylinder port 100 and blocks the passage of fluid between the first port 98 and the cylinder port 100. In its actuated position, the second valve 79 (actually the core) permits the passage of fluid between the first port 98 and the cylinder port 100, and blocks the passage of fluid between the second port 99 and the cylinder port 100.

The outlet line 65 of the control valve 16 is connected to the supply port 91 of the first valve 78. Connected for fluid communication between the first ports 93 and 98 of the first and secOnd valves 78 and 79 is a first passageway 104. The first passageway 104 includes the elbow 105 connected to the first valve first port 93, the first variable braking valve 81 connected thereto, the connected upper line 86, the elbow 84 which is connected to the upper line 86, and the adjoining elbow 105 which in turn is connected to the first port 98 of the second valve 79. Connected for fluid communication between the second ports 94 and 99 of the first and second valves 78 and 79 is the second passageway 106. A passageway, such as the first and second passageways 104 and 106, is defined to be any structure forming a passage for fluid communication between two points. The second passageway includes the elbow 105 connected to the second port 94 of the first valve 78, the second variable braking valve 82 connected thereto, the connected lower line 87, the variable push valve 83 which is connected to the lower line 87, and the adjoining elbow 105 which connects into the second port 99 of the second valve 79. An elbow 108 connects the cylinder port line 89 to the cylinder port 100. At the hole 110 in the plate 77, two elbows 112 and 113 connect the cylinder port line 89 to the cylinder line 115 which is connected at the other end to the cylinder 22.

The first variable braking valve 81, second variable braking valve 82, and the variable push valve 83 are identical check valves of conventional known construction which are adapted to permit unrestricted flow in one direction, but to selectively restrict the flow of fluid in the other direction. Thus the first variable braking valve 81 permits fluid to flow unrestrictively from the first port 93 of the first valve 78 to the first port 98 of the second valve 79, and permits selectively variable restriction of the fluid flow from the first port 98 of the second valve 79 to the first port 93 of the first valve 78. Similarly, the second variable braking valve 82 permits unrestricted fluid flow from the second port 94 of the first valve 78 to the second port 99 of the second valve 79, and permits selectively variable restriction of the fluid flow from the second port 99 of the second valve 79 to the second port 94 of the first valve 78. The variable push valve 82 permits unrestricted fluid flow from the second port 99 of the second valve 79 to the second port 94 of the first valve 78, and permits selectively variable restriction of the fluid flow from the second port 94 of the first valve 78 to the second port 99 of the second valve 79. Selectively variable restriction of the fluid flow in the restrictable direction through the variable check valves 81, 82 and 83 may be accomplished by turning the valve handle.

The variable speed controller 12 may be manufactured as a kit which can be added to the door operator, but preferably is assembled as an integral component of the variable speed door operator 10 before being sold. The variable speed control 12 is attached to the inertia operator 13 by two bolts 116 which connect the plate 77 to the frame 18. The outlet line 65 and cylinder line 115 need to be connected to the variable speed controller 12 as shown in FIG. 2 and described above.

Figure 6:
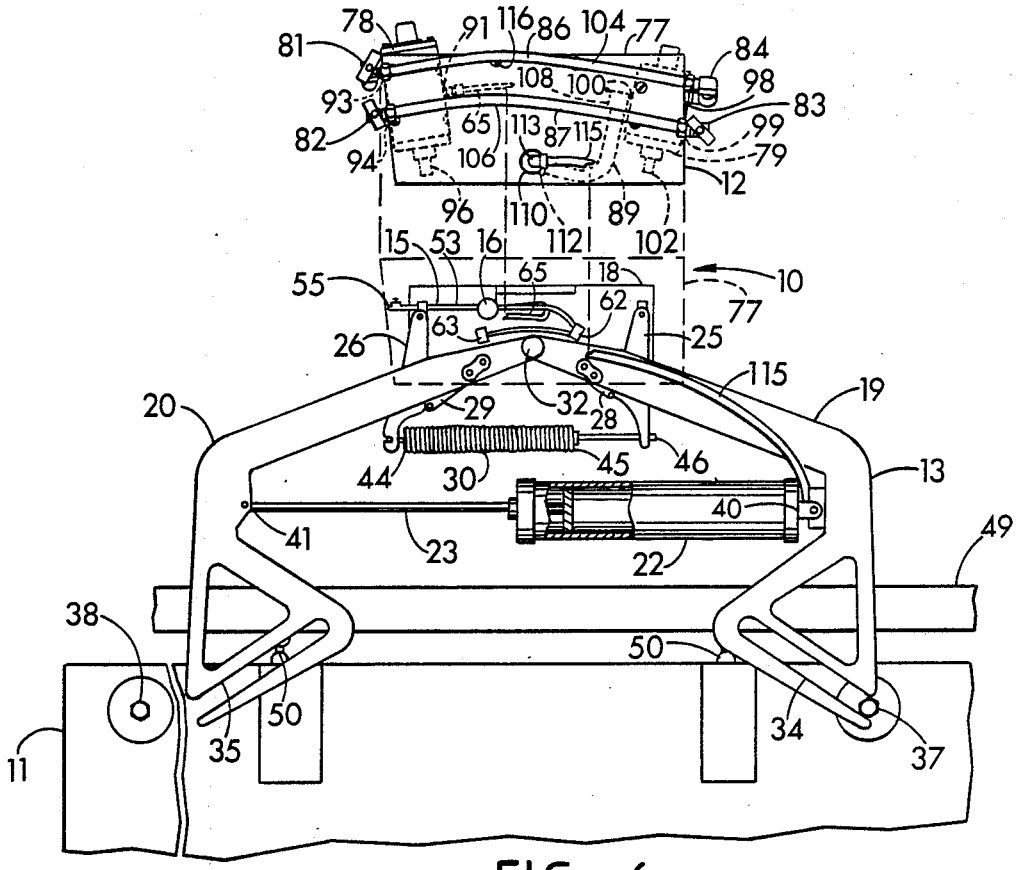
FIG. 6 is a front elevational view of the variable speed door operator of FIG. 1, with the variable speed controller projected above the inertia operator, and the door shown in an intermediate position between the two open and positions.
Figure 7:
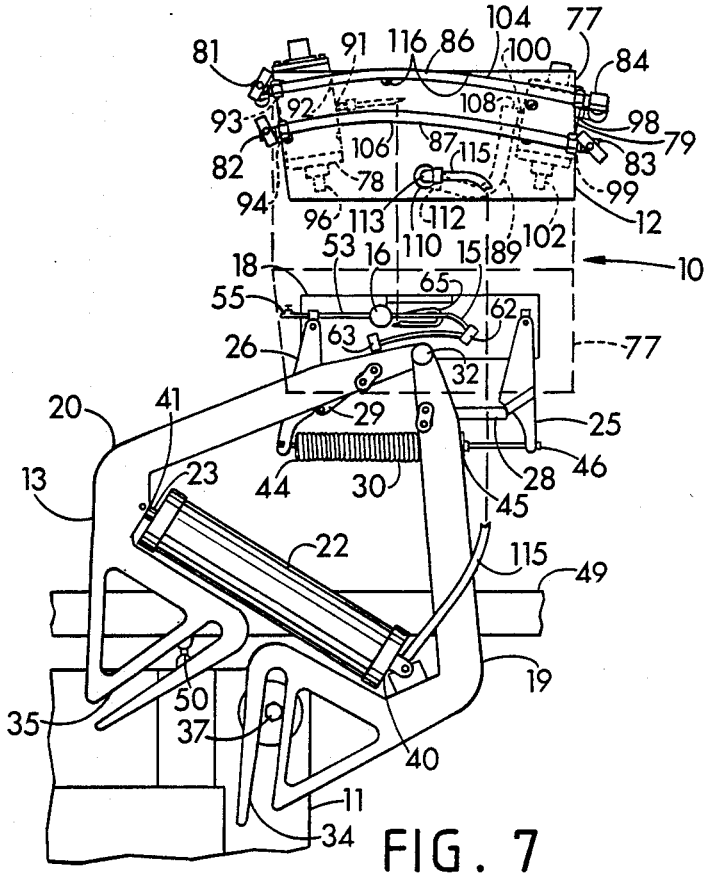
FIG. 7 is a front elevational view of the variable speed door operator of FIG. 1, with the variable speed controller projected above the inertia operator, and with the door in its second position which corresponds to the open position.
Figure 8:
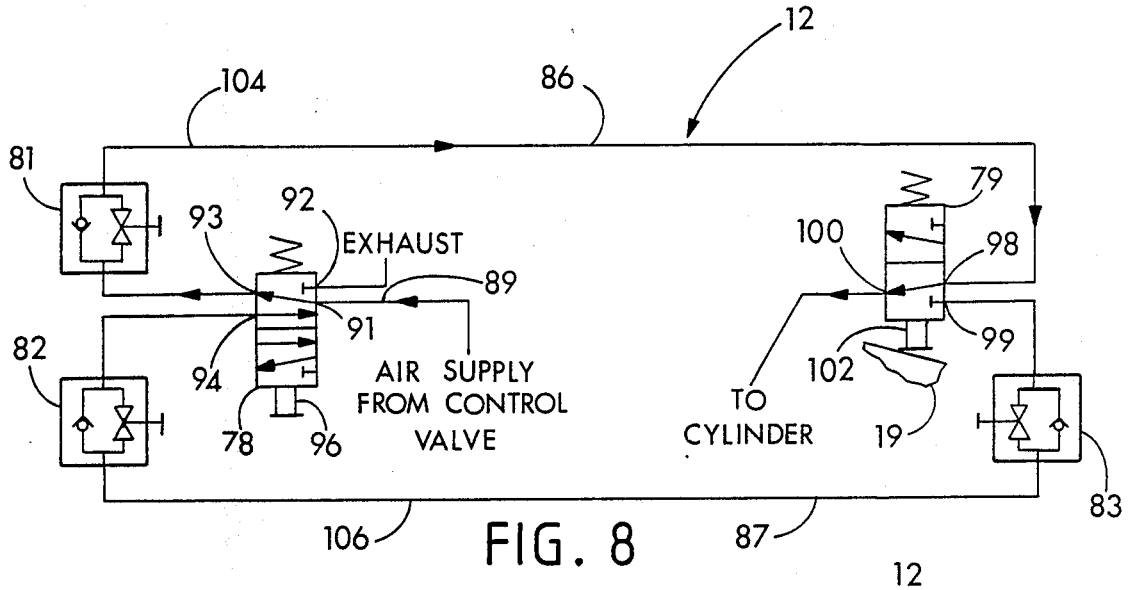
FIG. 8 is a schematic diagram of the variable speed controller when in operation to initiate movement of the door from position to its second position.

Operation of the variable speed door operator 10 is best demonstrated in FIGS. 2, and 6–12. FIGS. 8–12 show schematically the various routes through which the pressurized fluid will move within the variable speed controller 12 as the door 11 is opened and closed. Initially when the door 11 is in its first or closed position, the right and left main levers 19 and 20 are swung to the right with the left door post 38 positioned within the slot 35 in the left main lever 20, and the right main lever 19 is pressed against the first bleed valve 62 and second sensor actuator 102 which causes the second valve 79 to be actuated, as shown in FIGS. 2 and 8. The first valve 78 is in its normal position since the first sensor actuator 96 is untouched by the left main lever 20. For the purposes of this example, the first position is said to be the closed position, so that the door 11 opens leftwardly.

Movement of the door 11 is initiated by momentarily opening the energizing valve 60, which causes the control valve 16 to permit pressurized fluid to flow to the first valve 78 through the supply port 91. As shown in FIG. 8, the pressurized fluid flows unrestrictedly through the first valve 78, and the first passageway 104 including the first variable braking valve 81, to the second valve 79. The pressurized fluid then flows through the second valve 79 to the cylinder 22 which drives the piston rod 23 to push the left main lever 20 and door 11 to the left. The left main lever 20 essentially moves the door 11 toward the second position, which for this example will be considered to be the open position.

The door 11 is said to be "in proximity to" one of the first or second positions whenever the door 11 is closest to that position, and pressurizing or exhausting of the cylinder 22 is necessary to movement of the door 11. The terminology "in proximity to" a position is intended also to include the situation when the door is exactly or almost exactly in the first or second position.

Figure 9:
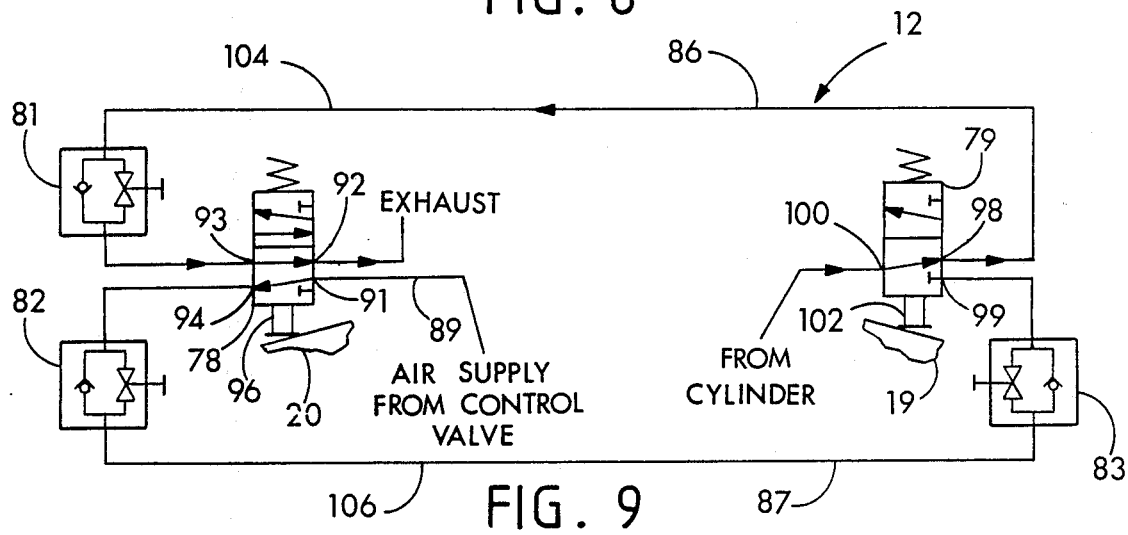
FIG. 9 is a schematic diagram of the variable speed controller when the door is in a position intermediate the first and positions and the right and left main levers ar pressed against the sensor actuators.

As the left main lever 20 moves leftwardly, the door 11 continues to be in proximity to the first or closed position until the cylinder 22 is fully expanded and the door continues to the left under its own momentum instead of being pushed by the left main lever 20. As shown in FIGS. 6 and 9, as the door slides to the left, the left main lever 20 is pressed against the first sensor actuator 96 so that the first valve 78 is also now in its actuated position.

Whenever the right and left main levers 19 and 20 are pushed by the cylinder 22 to their respective sides as shown in FIG. 6, the door 11 will be in some position intermediate the first or second positions. When pushed to their respective sides, the levers 19 and 20 will press against both bleed valves 62 and 63 thereby deenergizing the control valve 16 which interrupts the flow of air from the source 52 to the cylinder 22. Additionally, the pressurized fluid within the cylinder 22 is allowed to escape through the exhaust port 92 of the first valve 78, since the first valve 78 is in its actuated position.

As the door 11 moves under its own momentum to the left, eventually the right door post 37 is caught in the slot 34 in the right main lever 19. The momentum of the door 11 causes the right main lever 19 to move leftwardly, thereby causing the cylinder 22 to be exhausted. Thus the door 11 is said to be in proximity to the second or open position.

Figure 10:
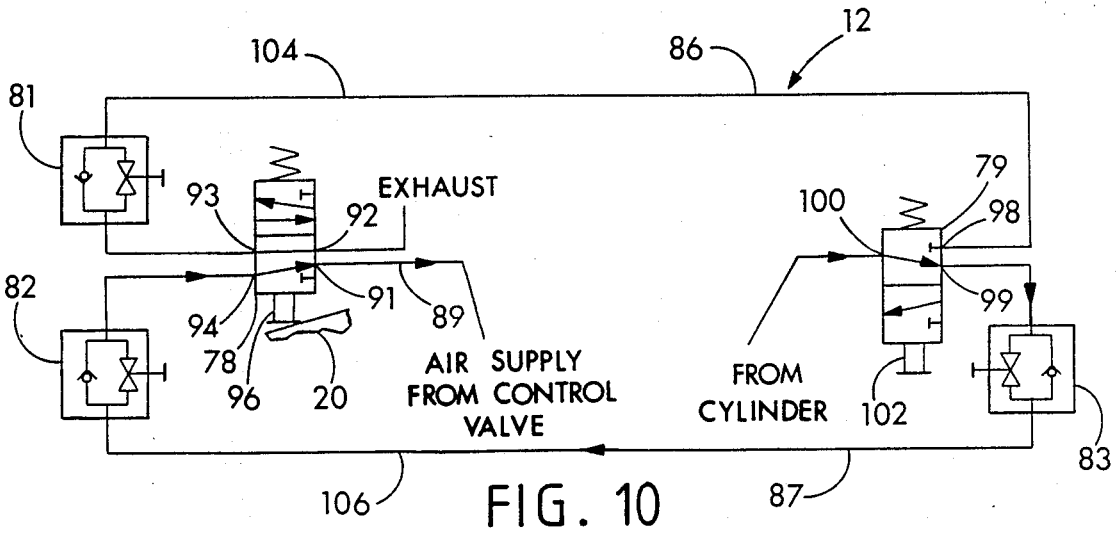
FIG. 10 is a schematic diagram of the variable speed controller when in operation to exhaust air from the cylinder through the second passageway and control valve when the door is in proximity to its second position and is being slowed as it reaches that position.

While the right main lever 19 is still pressing against the second sensor actuator 102, pressurized fluid is exhausted through the exhaust port 92 of the first valve 78 as shown in FIG. 9. Almost immediately though, the right main lever 19 is removed from the second sensor actuator 102, and as shown in FIG. 10, the cylinder air is exhausted by way of the second passageway 106 and through the supply port 91 of the first valve 78. Since the control valve 16 is deenergized, the passage of fluid from the control valve outlet 73 to its exhaust orifice 75, as illustrated in FIG. 3, is permitted. Thus while the door 11 is in proximity to its second position, pressurized fluid is exhausted from the cylinder 22 primarily through the second passageway 106. The pressurized fluid flows unrestrictively through the variable push valve 83 as it is exhausted. However, the pressurized fluid flows through the second variable braking valve 82 at a selected flow rate. Preferably the second variable braking valve 82 will be adjusted to provide some resistance to the passage of air so that the door 11 will not slam against anything when it reaches its second or open position. If the door 11 bounces back from the right main lever 19 and is not allowed to proceed to the second position, there is too much resistance to the fluid flow through the second variable braking valve 82. Then, the valve 82 should be opened slightly. If the door slams when it reaches its second position, the second variable braking valve 82 should be closed a slight amount.

Figure 11:
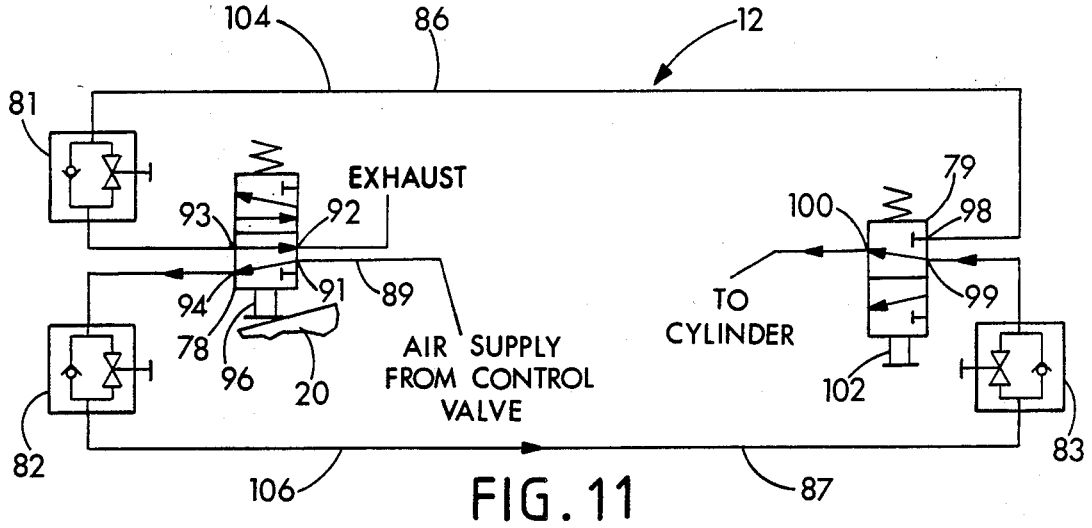
FIG. 11 is a schematic diagram of the variable speed controller when, movement of the door is being initiated from the second position to its first position.

When the door 11 reaches its second or open position, the variable speed operator 10 and door 11 are positioned as shown in FIG. 7. Since both the right and left levers 19 and 20 are moved to the left, the first valve 78 is actuated while the second valve 79 is in its normal position as shown in FIGS. 7 and 11. To initiate closing of the door 11, the energizing valve 60 is opened momentarily again, causing the control valve 16 to allow pressurized fluid to pass from the source 52 through the control valve 16 to the first valve 78 through the supply port 91 as shown in FIG. 11. The pressurized fluid flows through the first valve 78, and the second passageway 106 including the second variable braking valve 82 and the variable push valve 83, and the second valve 79 to the cylinder 22 which drives the piston 23. The fluid flow is against the check valve in the variable push valve 83 so that the fluid flow can be selectively regulated. Thus the speed, at which closing movement of the door is initiated, is selectively controlled by the variable push valve 83. If closing movement of the door 11 is too slow, the variable push valve 83 should be opened slightly. If the door closes too quickly, the variable push valve 83 should be closed slightly.

As the piston rod 23 extends from the cylinder 22, the right main lever 19 drives the door 11 rightwardly at the selected speed while the door 11 is in proximity to its second or open position. Once the piston rod 23 is fully extended, the right main lever 20 stops moving rightwardly and the door 11 continues closing under its own momentum. At this point, the door 11 is said to no longer be in proximity to its second or open position. With the left main lever 20 fully to the left, and the right main lever 19 fully to the right, the two bleed valves 62 and 63 are both opened to deenergize the control valve 16, thereby interrupting the supply of pressurized fluid from the source 52 to the cylinder 22. Additionally, both the first and second valves 78 and 79 are placed again in their actuated positions as shown in FIGS. 6 and 9. Thus pressurized fluid within the cylinder 22 is allowed to escape through the exhaust port 92 of the first valve 78.

Figure 12:
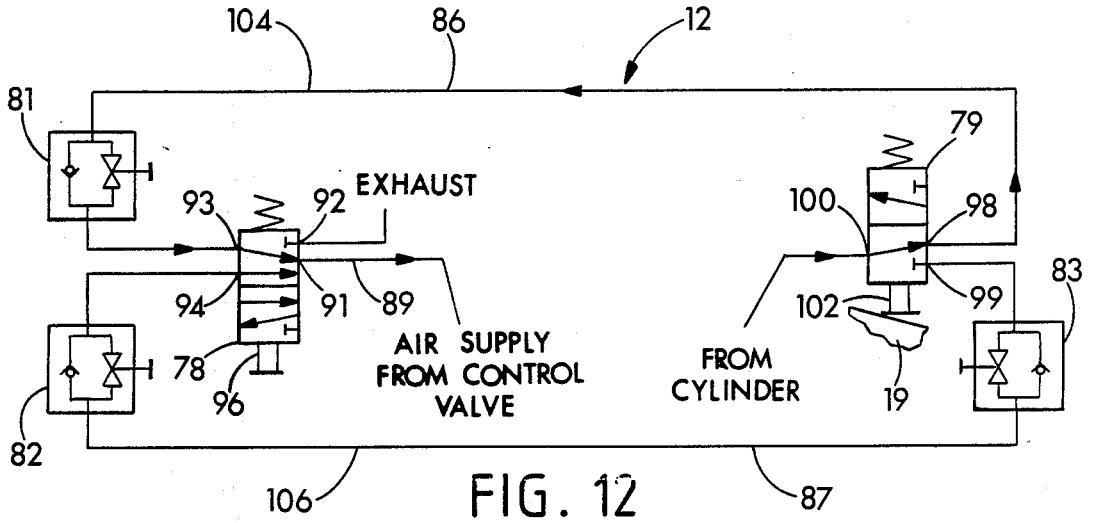
FIG. 12 is a schematic diagram of the variable speed controller showing fluid being exhausted from the cylinder through the first passageway and control valve when the door is in proximity to its first position, and the door is being slowed as it reaches that position.

Eventually the door 11 moves rightwardly to where the slot 35 in the left main lever 20 catches the left door post 38. When the left main lever 20 first catches the other door post 37 and moves rightwardly, pressurized fluid which is exhausted from the cylinder 22 is exhausted through the exhaust port 92 of the first valve 78 as shown in FIG. 9. The door 11 is then in proximity to its first or closed position. The exhausting through the exhaust port 92 allows the left main lever 20 to move rightwardly enough so that it is disengaged from the first sensor actuator 96, thereby allowing the first valve 78 to return to its normal position. The pressurized fluid is then exhausted from the cylinder 22 by way of the first passageway 104 and through the control valve 16 as shown in FIG. 12. Since the control valve 16 is deenergized, the pressurized fluid is allowed to pass from the control valve outlet 73 out its exhaust orifice 75. Thus, as the door 11 moves toward its closed position compressing the cylinder 22, the air which is exhausted from the cylinder 22 moves primarily through the first passageway 104 which includes the first variable braking valve 81. The exhaust flow of the fluid moves against the check valve in the first variable braking valve 81 and therefore can be selectively regulated. If the door 11 bounces back from the left main lever 20 without following through to the first or closed position, the first variable braking valve 81 is closed too much and should be opened slightly. If the door 11 slams into its first or closed position, the first variable braking valve 81 should be closed slightly. Once the door 11 is again in its first or closed position, the door 11 is ready to be reopened.

It is often desirable to open the door quickly. However, a rapidly closing door may be undesirable. It is therefore particularly desirable to control the speed of the door 11 when it is closing. Although it is generally beneficial to have a door close more slowly than it opens, in some applications it might be desirable to have the door open more slowly than it closes. In such a case, the open position would become the first position, and the closed position would become the second position. Additionally, in various applications, it might be desirable to close a door leftwardly at a selectively controlled speed, instead of rightwardly as in the example. In such an embodiment, it would be necessary to interchange the elbow 84 and the variable push valve 83, so that the passageway 104 with the upper line 86 would become a second passageway, and the passageway 106 with the lower line 87 would become a first passageway. The first position would then be to the left, and the second position to the right. In other applications, it might be beneficial for the sensor actuators to be electrical switches connected to solenoids which move the cores of the first and second valves. In another alternative, one or more of the first and second valves 78 and 79 might be actuated or returned to normal position when the door is almost exactly at an open or closed position instead of when the door is nearby the positions. Also, the sensor actuators might be contacted directly by the door to determine door position, instead of the sensor actuators determining door position indirectly through the position of the operator. In particular, this might be necessary in the use of the variable speed controller 12 with the swing operator disclosed in U.S. Pat. Nos. 3,244,415 and 3,291,003. Since the swing operator itself is always in the same position when the door is fully open or closed, the variable speed controller 12 would be unable to determine, indirectly through the position of the swing operator, whether the door is opened or closed. Therefore, one of the sensor actuators might necessarily come into direct contact with the door as the door reaches one of its positions. On the other hand, since the over-center operator moves with the door, the position of the door could be determined indirectly by the position of the over-center operator.

It is to be understood that the present invention is not limited to the particular arrangement and embodiments of parts disclosed and illustrated herein, nor to the material specified, but embraces all such modified forms thereof as come within the scope of the following claims.

What is claimed is:

1. A variable speed controller for selectively varying a moving speed of a door which is moved between first and second positions by an automatic door operator having a control system and a cylinder with a reciprocating piston therein which is positioned identically with respect to the cylinder when the door is in both the first and second positions, comprising:

(a) A first passageway;

(b) A second passageway;

(c) At least one door position responsive valve means operably connected to the control system, cylinder and said passageways for directing fluid from the control system through the first passageway to the cylinder to initiate movement of the door toward the second position when the door is in proximity to its first position and the control system is discharging the fluid; and for directing fluid from the control system through the second passageway to the cylinder to initiate movement of the door toward the first position when the door is in proximity to its second position and the control system is discharging the fluid; and (d) variable check valve means in the second passageway for permitting unrestricted fluid flow from the cylinder to be exhausted when fluid is exhausted from the cylinder through the second passageway, and for permitting selectively variable restriction of fluid flow from the control system to the cylinder through the second passageway so that movement of the door from the second position to the first position may be initiated at a selected speed.

2. The variable speed controller specified in claim 1 wherein the fluid directing valve means further directs fluid from the cylinder to be exhausted through the first passageway when the door moves toward the first position and is in proximity thereto; and the variable speed controller further includes a first variable braking valve in the first passageway which permits unrestricted fluid flow from the control system to the cylinder, and which permits selectively variable restriction of fluid flow from the cylinder which is exhausted through the first passageway, so that the cylinder exhausts at a selected rate, thereby controlling the speed at which the door moves to rest in the first position.

3. The variable speed controller specified in claim 1 wherein the fluid directing means further directs fluid from the cylinder to be exhausted through the second passageway when the door moves toward the second position and is in proximity thereto; and the variable speed controller further includes a second variable braking valve in the second passageway which permits unrestricted fluid flow from the control system to the cylinder, and which permits selectively variable restriction of fluid flow from the cylinder which is exhausted through the second passageway, so that the cylinder exhausts at a selected rate, thereby controlling the speed at which the door moves to rest in the second position.

4. A variable speed controller for controlling moving speed of a door which is moved between first and second positions by an automatic door operator with control system, comprising:

(a) a first valve including a body having a supply port for communicating connection to the control system to receive fluid therefrom, a first port and a second port; and a first sensor actuator connected to allow the first valve to return to a normal position from an actuated position when the door is in proximity to the first position, wherein in the normal position the first valve permits passage of fluid between the supply port and the first port, and blocks passage of fluid between the supply port and the second port, and wherein in the actuated position the first valve permits passage of fluid between the supply port and the second port, and blocks passage of fluid between the supply port and the first port;

(b) a second valve including a body having a first port, a second port and a cylinder port for communicating connection with a cylinder in the operator to direct and receive fluid therefrom; and a second sensor actuator connected to allow the second valve to return to a normal position from an actuated position when the door is in proximity to the second position, wherein in the normal position the second valve permits passage of fluid between the second port and the cylinder port and blocks passage of fluid between the first port and the cylinder port, and wherein in the actuated position the second valve permits passage of fluid between the first port and the cylinder port and blocks passage of fluid between the second port and the cylinder port;

(c) a first passageway connected to the first ports of the first and second valves for fluid communication therebetween; and (d) a second passageway connected to the second ports of the first and second valves for fluid communication therebetween, said second passageway including a variable push valve which permits unrestricted flow from the second port of the second valve to the second port of the first valve and permits selectively variable restriction of fluid flow from the second port of the first valve to the second port of the second valve;

wherein when the door is in proximity to the first position, fluid can be directed from the control system to the cylinder to initiate movement of the door toward the second position; and when the door is in proximity to the second position, fluid can then be selectively restrictively directed from the control system to the cylinder to initiate movement of the door toward the first position at a selected speed.

5. The variable speed controller specified in claim 4 wherein when the door moves toward its first position and is in proximity thereto, fluid can be directed from the cylinder to be exhausted through the first passageway to thereby allow the door to continue to the first position, and wherein the first passageway includes a first variable braking valve which permits unrestricted fluid flow from the first port of the first valve to the first port of the second valve and permits selectively variable restriction of fluid flow from the first port of the second valve to the first port of the first valve, so that fluid which is directed from the cylinder through the first passageway to be exhausted is exhausted at a selected rate, thereby controlling the speed at which the door moves to rest in the first position.

6. The variable speed controller specified in claim 4 wherein when the door moves toward its second position and is in proximity thereto, fluid can be directed from the cylinder to be exhausted through the second passageway to thereby allow the door to continue to the second position, and wherein the second passageway further includes a second variable braking valve which permits unrestricted fluid flow from the second port of the first valve to the second port of the second valve and permits selectively variable restriction of fluid flow from the second port of the second valve to the second port of the first valve, so that fluid which is directed from the cylinder through the second passageway to be exhausted is exhausted at a selected rate, thereby controlling the speed at which the door moves to rest in the second position.

7. A variable speed door operator for moving a door between a first and a second positions, comprising:

(a) a source of pressurized fluid;

(b) a cylinder including a piston located in reciprocable relation within the cylinder; the cylinder and piston being connected within the operator such that when pressurized fluid is supplied to the cylinder, the piston and cylinder will initiate movement of the door from one position to the other; and such that the piston will exhaust the pressurized fluid from the cylinder during completion of the movement of the door to the other position;

(c) a control valve having an inlet in communication with said source of pressurized fluid, an outlet, and an exhaust orifice, said control valve including a control valve core located within the control valve, the control valve core having a first position wherein said valve core permits the passage of fluid from said fluid source out the outlet and prevents the passage of fluid from the outlet to the exhaust orifice, and a second position wherein said control valve core prevents the passage of fluid from the outlet to the inlet and permits the passage of fluid from the outlet to the exhaust orifice;

(d) an energizing means connected to said control valve for moving said control valve core to the first position until de-energized;

(e) at least one de-energizing means connected to said control valve for causing the control valve core to return to the second position when the door is in a position intermediate the positions;

(f) a first passageway;

(g) a second passageway;

(h) at least one door position responsive valve means operably connected to the control valve, cylinder and said passageways for directing fluid from the control valve through the first passageway to the cylinder to initiate movement of the door toward the second position when the door is in proximity to its first position and the control valve is discharging the fluid; and for directing fluid from the control valve through the second passageway to the cylinder to initiate movement of the door toward the first position when the door is in proximity to its second position and the control valve is discharging the fluid; and (i) a variable push valve in the second passageway which permits unrestricted fluid flow from the cylinder to be exhausted when fluid is exhausted from the cylinder through the second passageway, and which permits selectively variable restriction of fluid flow from the control valve to the cylinder through the second passageway so that movement of the door from the second position to the first position may be initiated at a selected speed.

8. The variable speed door operator specified in claim 7 wherein the fluid directing valve means further directs fluid from the cylinder to be exhausted through the first passageway when the door moves toward the first position and is in proximity thereto; and the variable speed door operator further includes a first variable braking valve in the first passageway which permits unrestricted fluid flow from the control valve to the cylinder, and which permits selectively variable restriction of fluid flow from the cylinder which is exhausted through the first passageway, so that the cylinder exhausts at a selected rate, thereby controlling the speed at which the door moves to rest in the first position.

9. The variable speed door operator specified in claim 7 wherein the fluid directing means further directs fluid from the cylinder to be exhausted through the second passageway when the door moves toward the second position and is in proximity thereto; and the variable speed door operator further includes a second variable braking valve in the second passageway which permits unrestricted fluid flow from the control valve to the cylinder, and which permits selectively variable restriction of fluid flow from the cylinder which is exhausted through the second passageway, so that the cylinder exhausts at a selected rate, thereby controlling the speed at which the door moves to rest in the second position.

10. A variable speed door operator for moving a door between a first and a second positions, comprising:

(a) a source of pressurized fluid;

(b) a cylinder including a piston located in reciprocable relation within the cylinder; the cylinder and piston being connected within the operator such that when pressurized fluid is supplied to the cylinder, the piston and cylinder will initiate movement of the door from one position to the other; and such that the piston will exhaust the pressurized fluid from the cylinder during completion of the movement of the door to the other position;

(c) a control valve having an inlet in communication with said source of pressurized fluid, an outlet, and an exhaust orifice, said control valve including a control valve core located within the control valve, the control valve core having a first position wherein said valve core permits the passage of fluid from said fluid source out the outlet and a second position wherein said control valve core prevents the passage of fluid from the outlet to the inlet;

(d) an energizing means connected to said control valve for moving said control valve core to the first position until de-energized;

(e) at least one de-energizing means connected to said control valve for causing the control valve core to return to the second position when the door is in a position intermediate the positions;

(f) a first valve including a body having a supply port for communicating connection to the control valve to receive fluid therefrom, a first port and a second port; and a first sensor actuator connected to allow the first valve to return to a normal position from an actuated position when the door is in proximity to the first position, wherein in the normal position the first valve permits passage of fluid between the supply port and the first port, and blocks passage of fluid between the supply port and the second port, and wherein in the actuated position the first valve permits passage of fluid between the supply port and the second port, and blocks passage of fluid between the supply port and the first port;

(g) a second valve including a body having a first port, a second port and a cylinder port for communicating connection with a cylinder in the operator to direct and receive fluid therefrom; and a second sensor actuator connected to allow the second valve to return to a normal position from an actuated position when the door is in proximity to the second position, wherein in the normal position the second valve permits passage of fluid between the second port and the cylinder port and blocks passage of fluid between the first port and the cylinder port, and wherein in the actuated position the second valve permits passage of fluid between the first port and cylinder port and blocks passage of fluid between the second port and the cylinder port;

(h) a first passageway connected to the first ports of the first and second valves for fluid communication therebetween; and (i) a second passageway connected to the second ports of the first and second valves for fluid communication therebetween, said second passageway including a variable push valve which permits unrestricted flow from the second port of the second valve to the second port of the first valve and permits selectively variable restriction of fluid flow from the second port of the first valve to the second port of the second valve;

wherein when the door is in proximity to the first position, fluid can be directed from the control valve to the cylinder to initiate movement of the door toward the second position; and when the door is in proximity to the second position, fluid can then be selectively restrictively directed from the control valve to the cylinder to initiate movement of the door toward the first position at a selected speed.

11. The variable speed controller specified in claim 10 wherein when the door moves toward its first position and is in proximity thereto, fluid can be directed from the cylinder to be exhausted through the first passageway to thereby allow the door to continue to the first position, and wherein the first passageway includes a first variable braking valve which permits unrestricted fluid flow from the first port of the first valve to the first port of the second valve and permits selectively variable restriction of fluid flow from the first port of the second valve to the first port of the first valve, so that fluid which is directed from the cylinder through the first passageway to be exhausted is exhausted at a selected rate, thereby controlling the speed at which the door moves to rest in the first position.

12. The variable speed controller specified in claim 10 wherein when the door moves toward its second position and is in proximity thereto, fluid can be directed from the cylinder to be exhausted through the second passageway to thereby allow the door to continue to the second position, and wherein the second passageway further includes a second variable braking valve which permits unrestricted fluid flow from the second port of the first valve to the second port of the second valve and permits selectively variable restriction of fluid flow from the second port of the second valve to the second port of the first valve, so that fluid which is directed from the cylinder through the second passageway to be exhausted is exhausted at a selected rate, thereby controlling the speed at which the door moves to rest in the second position.

* * * * *

UNITED STATES PATENT AND TRADEMARK OFFICE

CERTIFICATE OF CORRECTION

PATENT NO. : 4,918,864

DATED : April 24, 1990

INVENTOR(S) : Lunenschloss et al.

It is certified that error appears in the above-identified patent and that said Letters Patent is hereby corrected as shown below:

Column 2, line 41, "door accordance" should be -- door operator in accordance --.

Column 2, line 56, "open and positions." should be -- open and closed positions. --.

Column 2, line 64, "from position to" should be -- from its first position to --.

Column 2, line 67, "first and positions" should be -- first and second positions --.

Column 2, line 68, "ar pressed" should be -- are both pressed --.

Column 3, line 7, the comma should be deleted after "when."

Column 5, line 53, "secOnd" should be -- second --.

Signed and Sealed this

Eighth Day of October, 1991

*Attest:*

*Attesting Officer*

HARRY F. MANBECK, JR.

*Commissioner of Patents and Trademarks*